US010227762B2

(12) United States Patent
Van Der Jagt et al.

(10) Patent No.: US 10,227,762 B2
(45) Date of Patent: Mar. 12, 2019

(54) TOILET TANK WASHBASIN

(71) Applicants: Culver Winston Van Der Jagt, Louisville, CO (US); Edward Lafe Altshuler, Erie, CO (US)

(72) Inventors: Culver Winston Van Der Jagt, Louisville, CO (US); Edward Lafe Altshuler, Erie, CO (US)

( * ) Notice: Subject to any disclaimer, the term of this patent is extended or adjusted under 35 U.S.C. 154(b) by 38 days.

(21) Appl. No.: 15/485,438

(22) Filed: Apr. 12, 2017

(65) Prior Publication Data

US 2017/0292257 A1 Oct. 12, 2017

Related U.S. Application Data

(60) Provisional application No. 62/321,200, filed on Apr. 12, 2016, provisional application No. 62/327,547, filed on Apr. 26, 2016.

(51) Int. Cl.

| | |
|---|---|
| ***E03D 1/00*** | (2006.01) |
| ***E03C 1/01*** | (2006.01) |
| ***E03D 5/00*** | (2006.01) |

(52) U.S. Cl.

CPC ..... *E03D 1/003* (2013.01); *E03C 1/01* (2013.01); *E03D 5/003* (2013.01)

(58) Field of Classification Search

CPC ..... E03B 1/041
USPC ..... 4/664–665
See application file for complete search history.

(56) References Cited

U.S. PATENT DOCUMENTS

| | | | | |
|---|---|---|---|---|
| 1,935,779 | A * | 11/1933 | Kemach | E03D 1/003 4/479 |
| 3,090,965 | A * | 5/1963 | Panze | A47K 7/08 4/353 |
| 3,588,922 | A * | 6/1971 | Carfora | E03D 1/003 4/665 |
| 4,653,128 | A * | 3/1987 | Canalizo | E03C 1/01 4/663 |
| 5,228,152 | A * | 7/1993 | Fraley | A47K 4/00 4/664 |
| 5,522,096 | A * | 6/1996 | Brown | E03D 1/003 4/340 |
| 5,813,047 | A * | 9/1998 | Teichroeb | E03D 1/003 4/364 |
| 8,024,823 | B2 * | 9/2011 | Sanaghan, Jr. | E03D 1/003 4/363 |
| 9,057,186 | B1 * | 6/2015 | Augustine | E03D 5/006 |
| 9,096,996 | B2 * | 8/2015 | Garza Laguera Garza | E03D 1/003 |

(Continued)

*Primary Examiner* — Lori Baker
(74) *Attorney, Agent, or Firm* — Kenneth Altshuler

(57) ABSTRACT

A toilet tank washbasin and faucet system that rests on top of a toilet tank is described by way of example. The faucet dispenses water intended to fill the toilet tank over a drain that leads into the toilet tank. The faucet is useful to a person for washing their hands with the water dispensed from the faucet to advantageously provide a second use of the water before flushing down the toilet. Generally described is a basin that sits atop an open toilet tank. A faucet having a nozzle end is attached to the basin via a keyed member that a) positions the nozzle end over a drain in the basin and b) prevents rotation of the faucet when attached to the basin, the drain leads into the toilet tank. Water is provided to a flexible tube that attaches to a bowl refill tube. The flexible tube extends through the faucet and terminates essentially at the nozzle end.

20 Claims, 10 Drawing Sheets

(56) References Cited

U.S. PATENT DOCUMENTS

| | | | | |
|---|---|---|---|---|
| 9,103,103 | B1 * | 8/2015 | McCann | E03C 1/01 |
| 9,554,556 | B2 * | 1/2017 | Ghasemi Chaleshtari | A01K 7/00 |
| 2013/0081202 | A1 * | 4/2013 | Shen | E03C 1/01 4/665 |

* cited by examiner

TOILET TANK WASHBASIN

CROSS-REFERENCE TO RELATED APPLICATIONS

This application is a non-provisional application which claims priority to and the benefit of U.S. Provisional Patent Application Ser. No. 62/321,299 entitled TOILET TANK WASHBASIN filed Apr. 12, 2016, the entire disclosure of which is hereby incorporated by reference and U.S. Provisional Patent Application Ser. No. 62/327,547 entitled TOILET TANK WASHBASIN filed Apr. 26, 2016, the entire disclosure of which is hereby incorporated by reference.

FIELD OF THE INVENTION

The present invention is directed to a washbasin and faucet system that rests on top of a toilet tank, the faucet dispenses water intended to fill the toilet tank.

BACKGROUND OF THE INVENTION

Our growing world population is straining our planet's natural resources, especially clean fresh water. In some geographical regions, fresh water is scarce. Accordingly, conservation of fresh water is a matter of survival for certain populations. It is to innovations related to addressing conservation of fresh water that the disclosed invention is generally directed.

SUMMARY OF THE INVENTION

The present invention is directed to a washbasin and faucet system that rests on top of a toilet tank, the faucet dispenses water intended to fill the toilet tank over a drain that leads into the toilet tank. The faucet is useful for a person to wash their hands with the water dispensed from the faucet to advantageously provide a second use of the water before flushing down the toilet.

Certain embodiments of the present invention contemplate a toilet tank washbasin comprising: a base; a rim extending from the perimeter of the base, the base and the rim defining a basin, the basin adapted to rest on top of a toilet tank; a drain that leads to the toilet tank; and a faucet possessing a faucet base attachable to the basin, the faucet extending from the faucet base distally to a faucet end, the faucet further possessing a tube extending essentially from the faucet end beyond the faucet base and terminating at a proximal tube end, the tube passing through an accommodating opening in the base, the proximal tube end adapted to attach to a bowl refill tube, the bowl refill tube is a water source to the toilet tank, water provided by the bowl refill tube is directed towards the drain via the faucet end; and the faucet base possessing a key protrusion that mates with a key slot in the base that rigidly positions the faucet end over the drain.

Embodiments of the toilet tank washbasin further contemplate the basin essentially conforms to the top of the toilet tank, the faucet is curved towards the base, that the tube 228 is flexible, that the faucet further possesses a plurality of barbs integrated at the faucet end, or that the barbs possess the ramped portion that is widest closest to the faucet end and terminating with an edge having an angle less than 90 degrees relative to the ramp, or that there is at least one Barb adapted to retain the tube 228 unidirectionally (one direction) in the faucet 202 at essentially at the faucet end 404, or that the faucet further possesses a plurality of rib structures in the faucet to position the tube along the faucet, or that the washbasin possesses a platform extending from the base to accommodate a faucet base, and at the faucet is secured to the faucet base via a threaded nut, or optionally that the faucet further comprises a bite ring adapted to permit the tube to move only in one direction through the bite ring the one direction being towards the faucet end, or that the washbasin itself further comprises an internal lip and an external lip that extend from the basin to prevent the toilet tank base washbasin from sliding off of the top of the toilet tank.

Other embodiments described below contemplate a toilet tank washbasin comprising: a basin that sits atop an open toilet tank; a faucet having a nozzle end, the faucet attached to the basin via a keyed member that a) positions the nozzle end over a drain in the basin and b) prevents rotation of the faucet when attached to the basin, the drain leads into the toilet tank; a flexible tube that attaches to a bowl refill tube, the bowl refill tube is a water source to the toilet tank, the flexible tube extends through the faucet and terminates essentially at the nozzle end; and a means for retaining the flexible tube at the nozzle end.

Embodiments of this toilet tank washbasin further contemplates that the means for retaining the flexible tube at the nozzle end prevents the flexible two from slipping out of the nozzle end, or that the toilet tank washbasin further comprises at least one retaining member that extends on both the outside of the toilet tank preventing the toilet tank washbasin from sliding off the top of the toilet tank, or where in the toilet tank washbasin possesses a periphery that essentially conforms to the top of the toilet tank, or wherein the faucet possesses a plurality of ripped channels that can retain the flexible tube along the inside of the faucet, or the washbasin further comprises a raised platform extending from the basin, the faucet attached to the raised platform.

Yet other embodiments of the present invention described below contemplate a toilet tank washbasin comprising: a basin adapted to sit atop an open toilet tank; a faucet having a nozzle end, the faucet attached to the basin via a keyed member that rotationally locks the faucet nozzle end over a drain in the basin, the drain leading into the toilet tank; a flexible tube adapted to attach to a bowl refill tube, the bowl refill tube is a water source to the toilet tank, the flexible tube extends through the faucet and terminates essentially at the nozzle end; and a means for retaining the flexible tube at the nozzle end. Certain other embodiments contemplate the toilet tank washbasin possessing a periphery that essentially conforms to the top of the toilet tank.

DETAILED DESCRIPTION

Initially, this disclosure is by way of example only, not by limitation. Thus, although the instrumentalities described herein are for the convenience of explanation, shown and described with respect to exemplary embodiments, it will be appreciated that the principles herein may be applied equally in other types of dual-purpose use water systems.

Figure 1:
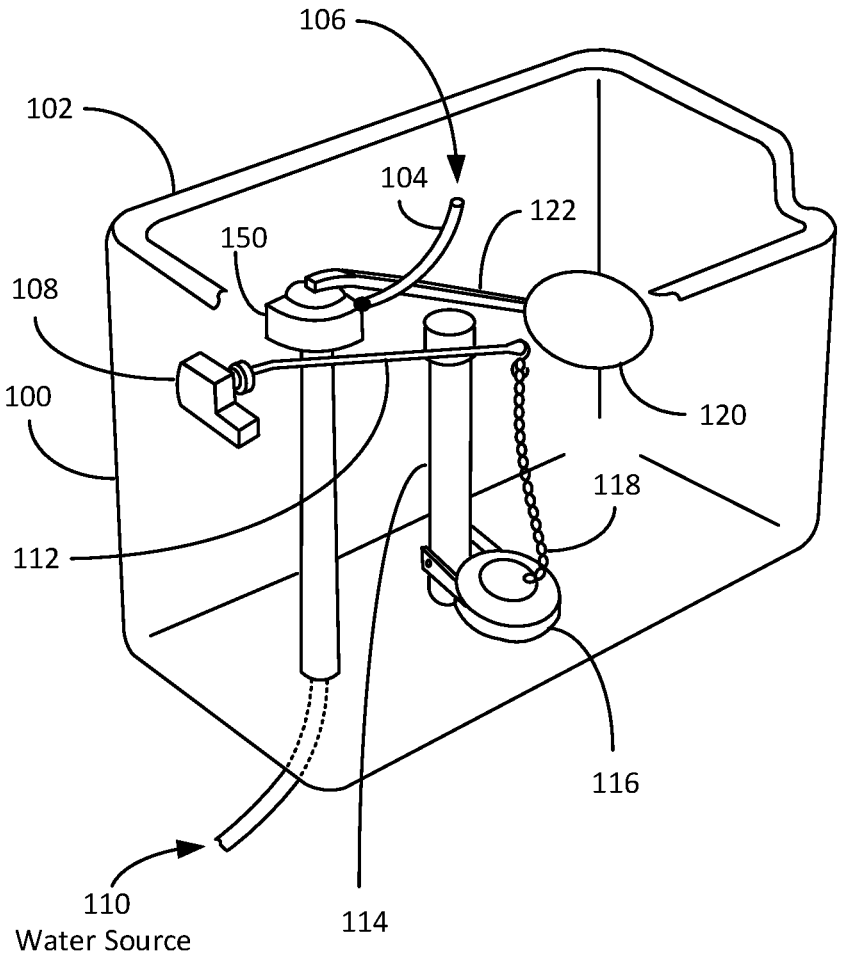
PRIOR ART FIG. 1
FIG. 1 illustratively depicts a standard toilet tank used as an exemplary environment in which preferred embodiments of the present invention can be practiced in accordance with embodiments of the present invention.

Embodiments of the present invention are generally directed to a toilet tank washbasin 200 (FIG. 2) that is arranged to rest on top of a toilet tank 100, shown in FIG. 1. The washbasin 200 replaces a toilet tank lid or cover (not shown) often covering the toilet tank 100. The toilet tank washbasin 200 does not have any moving parts and is connected by way of a faucet tube, such as a flexible tube 228, to the bowl refill tube 104. The faucet tube runs through the toilet tank washbasin 200 through a faucet 202 and to a nozzle end of the faucet 204. The toilet tank washbasin 200 replaces a standard toilet tank lid that normally rests atop the toilet tank 100. When a person flushes a toilet arranged with a toilet tank washbasin 200, water flows from the faucet 202 to a drain 208 in the toilet tank washbasin 200 and then from the drain 208 to the toilet tank 100. A person can wash their hands with the water that would normally flow unused into the toilet tank 100. The water used for hand washing flows down the drain 208 filling the toilet tank thus conserving water.

FIG. 1 depicts a standard toilet tank used as an exemplary environment in which preferred embodiments of the present invention can be practiced. The depicted toilet tank 100 typically rests behind a toilet bowl (not shown) and provides water to the toilet bowl to flush waste to a sewer or septic tank. The toilet tank 100 receives water from a water line 110 (water source). When the toilet tank 100 is essentially empty (i.e., after the toilet has been flushed), the float 120 attached to a lever arm 122 pivots towards the bottom 101 of the toilet tank 100 opening a shutoff valve (not shown) located in a shutoff valve housing 150. When a shutoff valve is open, water from the water line 110 freely flows through a bowl refill tube 104 to fill the toilet tank 100 with water. Typically, the bowl refill tube 104 is pointing downward directing water towards the bottom of the toilet tank 100 via the bowl refill tube end 106. The bowl refill tube end 106 is depicted pointing upward, which in one embodiment is ready to connect with a flexible tube end 230 (shown in FIG. 2D, for example) which feeds the faucet assembly 202 that is part of the toilet tank washbasin 200. As the water rises in the toilet tank 100, the float 120 rises with the water causing the lever arm 122 to close the shutoff valve. If the water rises too high in the toilet tank 100, the overflowing water passes into the toilet bowl via the toilet bowl fill/overflow tube 114 instead of over the top 102, or rim, of the toilet tank 100. When the toilet tank 100 is full of water, a person can toggle the flushing handle 108, which slightly rotates the lever 112 pulling open the flush valve and flapper 116 via the chain 118 causing the toilet bowl to fill with water and flush the toilet. When the water empties from the toilet tank 100, the flapper 116 closes and water from the bowl refill tube 104 refills the toilet tank 100. In this embodiment, extra water is saved by minimizing water retained in the toilet bowl.

Figure 2A:
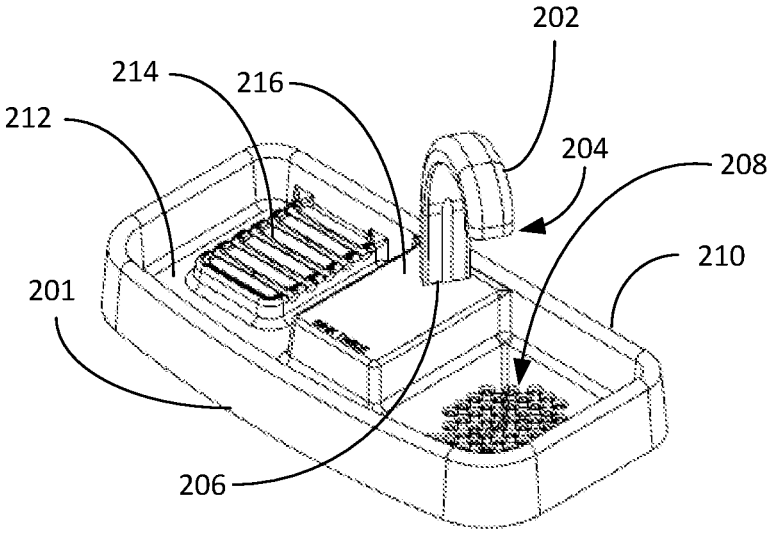
FIGS. 2A-2D illustratively depicts an embodiment of a toilet tank washbasin consistent with embodiments of the present invention.

FIG. 2A-2D depicts an embodiment of a toilet tank washbasin 200 consistent with embodiments of the present invention. As shown in FIG. 2A, the toilet tank washbasin 200 comprises a base 212 with a rim 210 extending from the perimeter of the base 212. The base 212 and the rim 210 define a basin 201. In some embodiments, the basin 201 essentially conforms to standard shapes and sizes of a toilet tank top 102. In other embodiments, the basin 102 conforms to a specific shape and size of a specific toilet tank top 102. In yet other embodiments, the basin 201 does not conform to the specific shape of a toilet tank top 102, but rests thereon nonetheless. The basin 201 further possesses a drain 208 that leads into the toilet tank 100. In the present embodiment, the basin 201 also comprises a platform 216 extending from the base 212 to accommodate a faucet 202. In the present embodiment, the basin 201 also comprises a soap pad 214 adapted to accommodate a bar of soap (not shown). The faucet 202 is attached to the basin 201 at a faucet base 206. The faucet 202 is curved and extends to a faucet end 204 that supports a nozzle through which water exits.

Figure 2B:
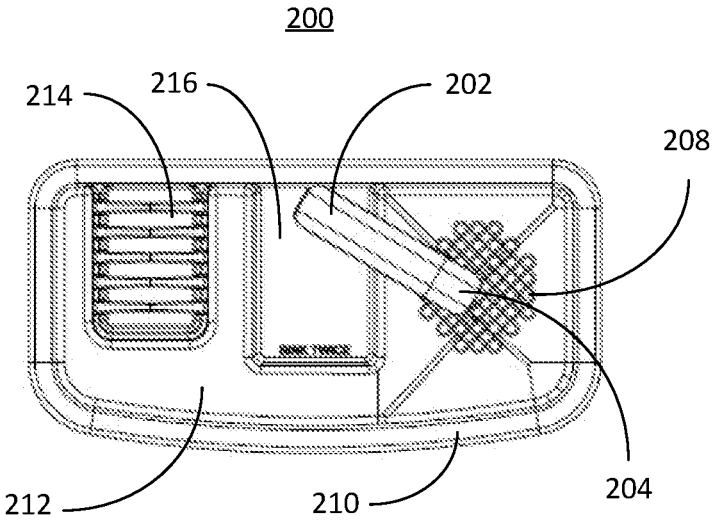
Figure 2C:
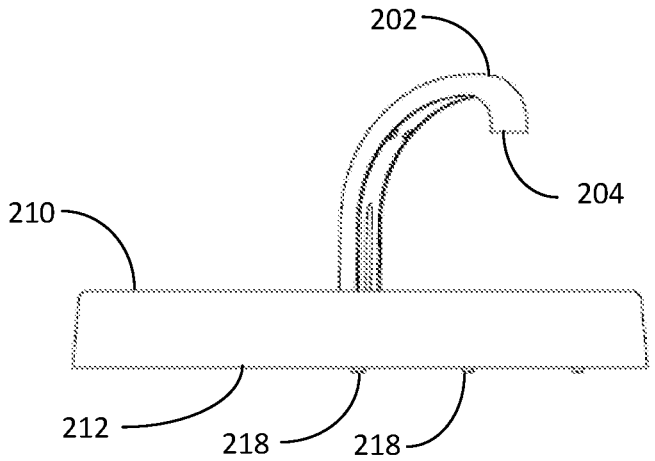
Figure 2D:
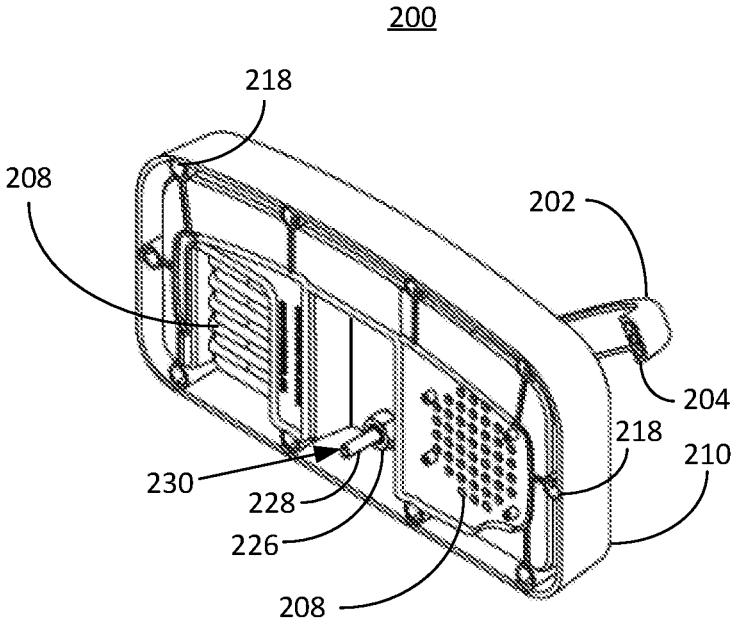

FIG. 2B depicts a top view of the toilet tank washbasin 200 consistent with FIG. 2A. As shown, the faucet end 204 is positioned over the drain 208. FIG. 2C shows a side view of the toilet tank washbasin 200 consistent with FIG. 2A. As shown here, internal and external retention lips 218 extend from the base 212 and butt up against the toilet bowl 100 to prevent the toilet tank washbasin 200 from sliding off the toilet bowl top 102. FIG. 2D depicts a bottom view of the toilet tank washbasin 200 consistent with FIG. 2A. The drain perforations 208 are shown penetrating through the basin 201, the retention lips 218 are visible extending slightly from the bottom surface 212 of the washbasin 200, and a faucet nut 226 is shown retaining the faucet to the basin 201. Extending from the faucet 202 is a flexible tube 228, such as a tygon tube, that terminates at a proximal tube end 230. The flexible tube end 230 is adapted to connect to the bowl refill to 104 by way of a standard hollow coupler (not shown). The basin 201 is envisioned to be made from molded plastic, machined plastic, printed plastic, stamped metal, printed metal, machined metal, ceramic (e.g., the same material and finish as the toilet bowl and toilet tank 100), just to name several examples. Certain embodiments contemplate a tube that is not flexible, such as copper tubing, for example. Yet other embodiments contemplate a tube leading to the faucet base 206 and an internal pathway in the faucet 202 that is not a tube providing a conduit for the water to exit the nozzle end 204.

Figure 3A:
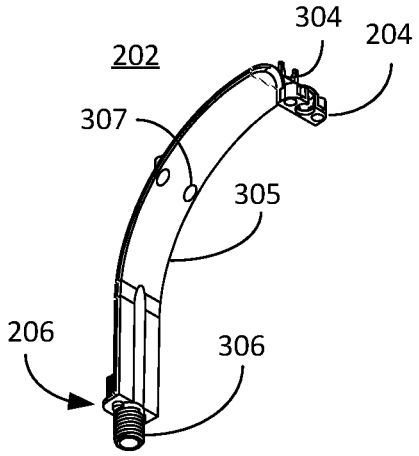
FIGS. 3A-3E depict an embodiment of a deconstructed faucet 202 providing an internal view of the faucet structure consistent with embodiments of the present invention.
Figure 3B:
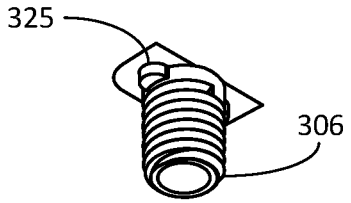

FIGS. 3A-3E depict an embodiment of a deconstructed faucet 202 providing an internal view of the faucet structure consistent with embodiments of the present invention. FIG. 3A illustratively shows a perspective view of the curved faucet support 305. Extending from the faucet base 206 is a threaded bolt member 306, which mates with an accommodating opening in the basin 201. Also located at the faucet base 206 is a key protrusion 325, or keyed member, which mates with a key slot (not shown) in the basin 201, shown larger in FIG. 3B. The key protrusion 325 both positions the nozzle end 204 so that water exiting the nozzle and 204 is directed over the drain 208, and the key protrusion 325 prevents rotation of the faucet 202 when attached to the basin 201. The curved faucet support 305 further depicts a pair of holes 307 to accommodate screws and a nozzle structure 304 located at the faucet end 204.

Figure 3C:
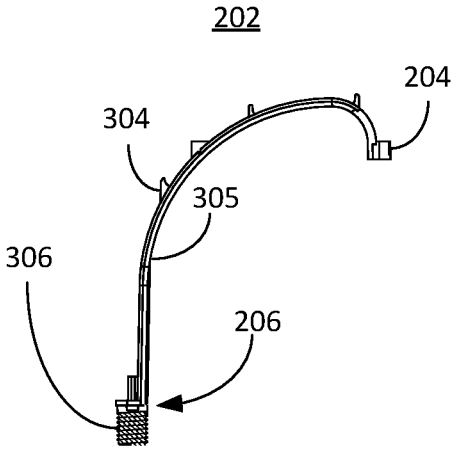

FIG. 3C depicts a side view of the curved faucet support embodiment consistent with FIG. 3A. As shown here, the curved faucet support 305 possesses ribbed guides 304 that guide the flexible tube 228 from the base end 206 to the nozzle end 204. In the embodiment associated with FIGS. 3A-3D, facilitate a flexible tube 228 facilitating the conduit for water extending the base end of the faucet 206 to the nozzle end 204.

Figure 3D:
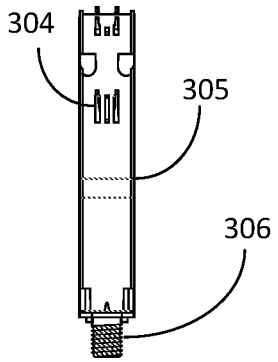

FIG. 3D illustratively depicts a back view of the curved faucet support 305 displaying the ribbed guides 304 that are sized to support and guide the flexible tube 228 from the base end 206 to the nozzle end 204. The ribbed guides 304 act as a channel that constrains the flexible tube 228 when the faucet cover 402 (shown in FIGS. 5A and 5B).

Figure 3E:
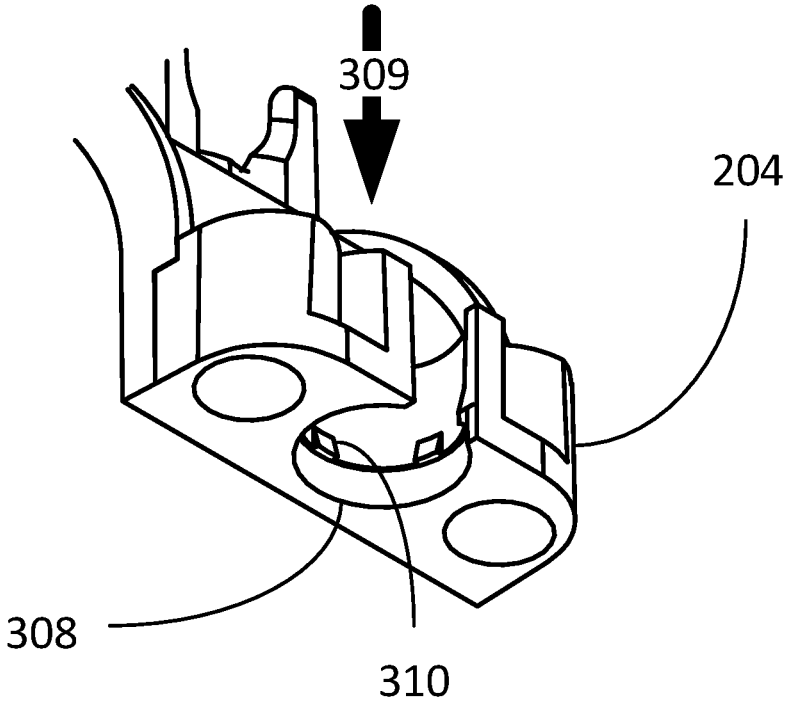

FIG. 3E depicts a close-up view of the nozzle end 204 embodiment consistent with the curved faucet support embodiment of FIG. 3A. As shown, the nozzle end 204 possesses a semicircular opening 308 that is sized and arranged to accommodate the flexible tube 228. Near the end of the semicircular opening 308 are a plurality of barbs 310 arranged to constrain the flexible tube 228 from creeping in the direction opposite the arrow 309. In other words, the tube 228 is retained unidirectionally (one direction) in the faucet 202 at essentially the distal end of the faucet. The barbs 310 are ramped so that the thickest end is closest to the distal end of the nozzle 204 and terminate at a sharp angle of less than 90°. This arrangement allows the flexible tube 228 to be threaded into the semicircular opening 308 in the direction of the arrow 309, but constrains the flexible tube 228 from going in a direction opposite the direction of the arrow 309. The barbs 310 keep the flexible 228 from slipping out of the semicircular opening 308 when water is pouring there through. Other embodiments include a bite ring with a barb that goes significantly around the semicircular opening 308. Yet other embodiments include a single barb 310. Certain embodiments envision the semicircular opening 308 being a full circle opening (enclosed on the entire periphery of the circle 308).

Figure 4A:
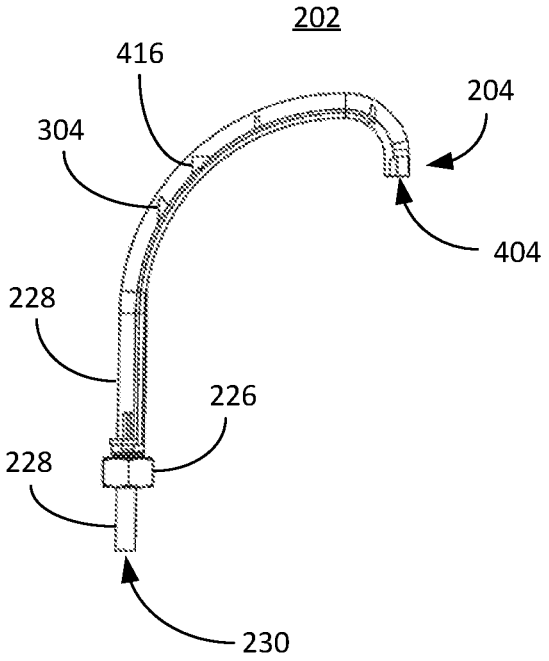
FIGS. 4A and 4B depicts the curved faucet support embodiment of FIG. 3 with the flexible tube positioned on the curved faucet support consistent with embodiments of the present invention.
Figure 4B:
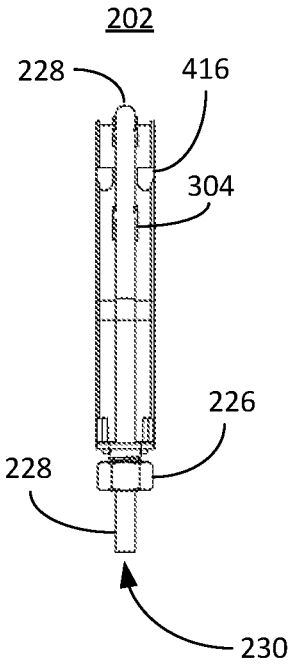

FIGS. 4A and 4B depict the curved faucet support embodiment of FIG. 3A with the flexible tube 228 positioned on the curved faucet support 305, consistent with embodiments of the present invention. FIG. 4A illustratively shows a side view of the flexible tube 228 positioned in the ribbed guides 304. Also depicted, is a channel guide 416. As shown, the flexible tube 228, which in this example is a unitary tube/conduit for water, extends beyond the base of the faucet 202 where it can attach to the bowl refill tube 104. The faucet nut 226 is used to secure the faucet to the basin 201. In this embodiment, the flexible tube 228 terminates at the distal end of the faucet forming a nozzle 404. FIG. 4B illustratively depicts the back view of the curved faucet support 305 displaying the ribbed guides 304 and the channel guide 416 that are sized to support and guide the flexible tube 228 from the base end 206 to the nozzle end 204, as shown. The ribbed guides 304 act as a channel that constrains the flexible tube 228 when the faucet cover 402.

Figure 5A:
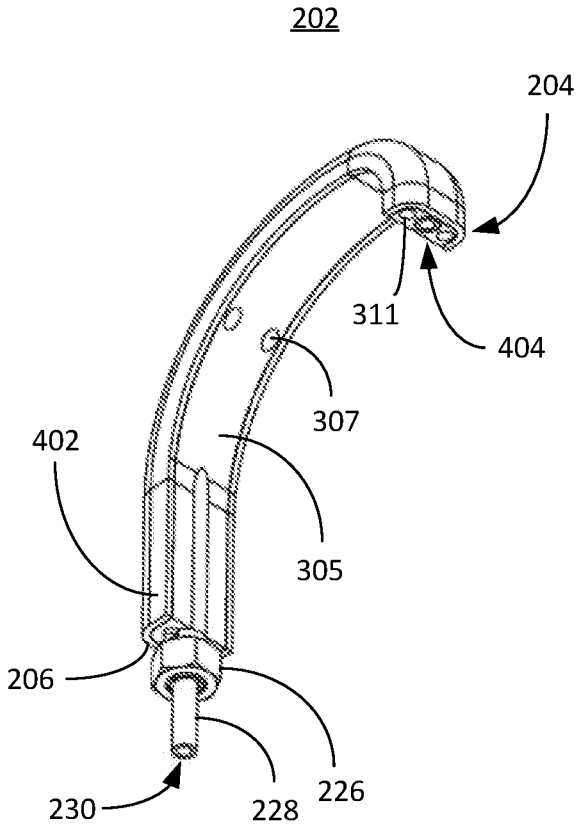
FIGS. 5A and 5B illustratively depict an embodiment of the complete faucet assembly consistent with embodiments of the present invention.
Figure 5B:
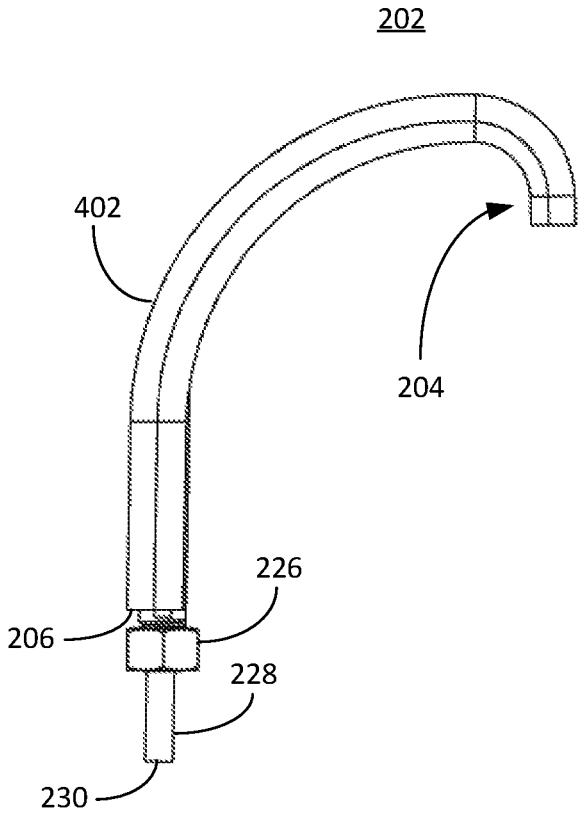

FIG. 5A depicts an embodiment of the complete faucet assembly 202 consistent with embodiments of the present invention. The faucet cover 402 is bolted down to the curved faucet support 305 via bolt holes 307 shown in the curved faucet support and also bolt holes 311 in the nozzle end 404. FIG. 5B depicts a side view of the embodiment of FIG. 5A.

Figure 6A:
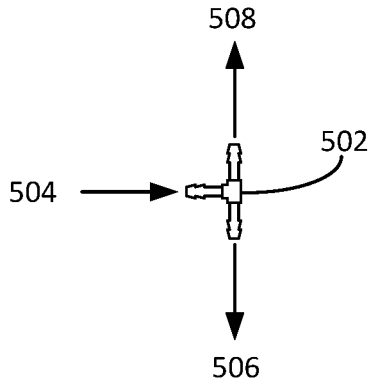
FIG. 6A illustratively depicts a three way connector that channels water in two directions consistent with embodiments of the present invention.
Figure 6B:
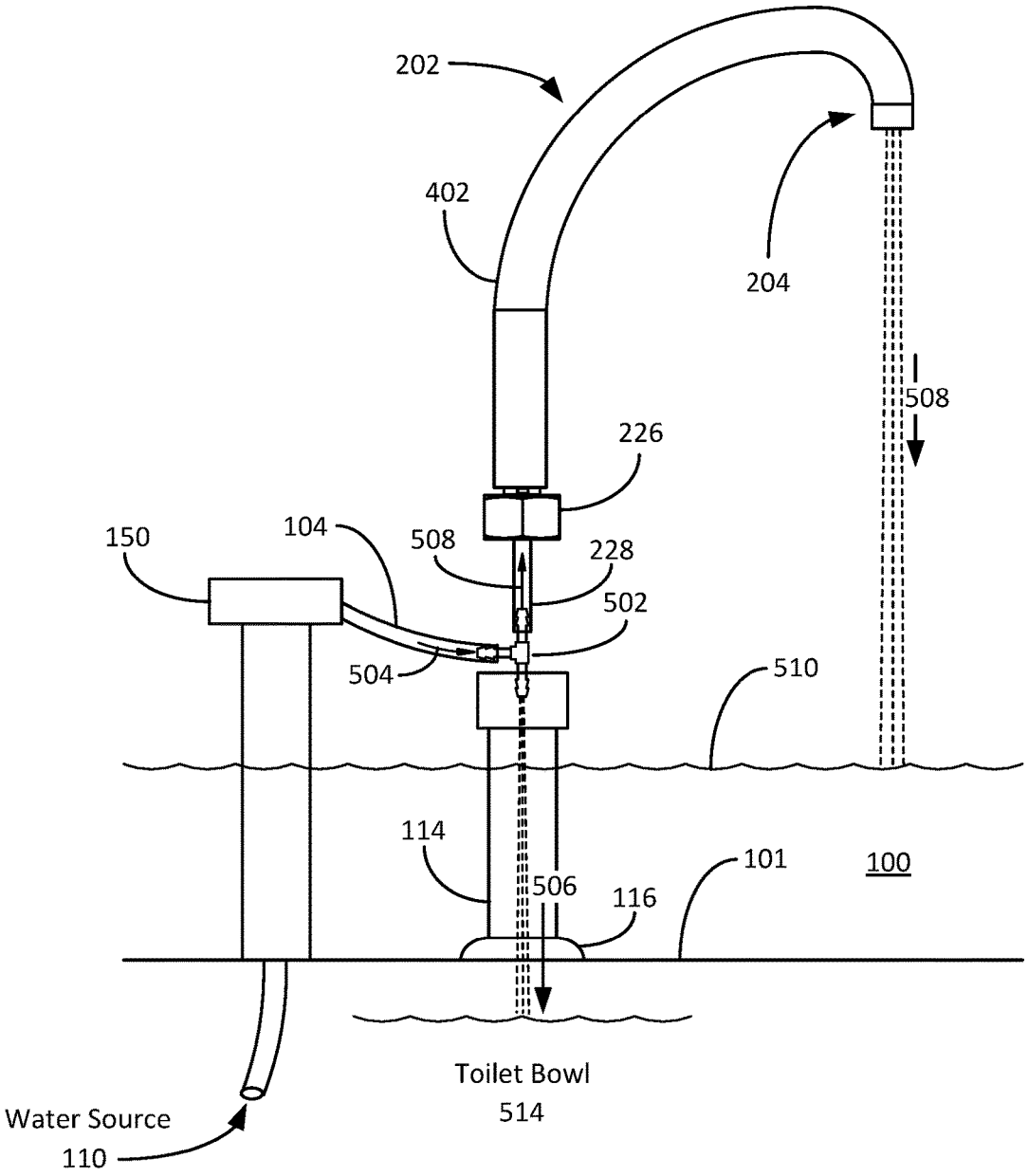
FIG. 6B illustratively depicts a side view of water flow in a toilet tank, toilet bowl, and faucet assembly consistent with embodiments of the present invention.

FIGS. 6A and 6B illustratively depict an optional embodiments to FIG. 1, whereby water is diverted to both the overflow and toilet bowl fill/overflow tube 114 and to the an equal three-way connector used as a water diverter consistent with embodiments of the present invention. Unlike FIG. 1, this embodiment fills the toilet bowl with a standard level of water to maintain a constant reservoir. FIG. 6A is one example of an equal three-way connector 502 that diverts incoming water 504 and a faucet direction 508 and a toilet bowl direction 506. A skilled artisan will recognize that a number of different diverters can be used to accomplish what the three-way connector 502 is accomplishing. Certain embodiments envision a diverter that restricts water going to the toilet bowl 514 in order to minimize water waste by filling the water in the toilet bowl 514 to a level that is less than or equal to maximum level water can rise in the toilet bowl freely (when the toilet drain (not shown) is not clogged).

FIG. 6B illustratively depicts a side view of the three-way connector 502 sending water to the faucet 202 and the toilet bowl fill tube 114 consistent with embodiments of the present invention. When the toilet is flushed (by way of all toggling the handle 108 as described in conjunction with FIG. 1), the float 120 actuates the shutoff valve to open allowing water to pass through the shutoff valve housing 152 and flow towards the toilet tank 102 via the bowl refill tube 104, see arrow 504. Water is diverted in the three-way connector 502 to a) fill, at least partially, the toilet bowl 514 via the toilet bowl fill tube 114, see arrow 506, and b) fill in the toilet tank 100 to a set level via the faucet 202, see arrow 508. As discussed above, certain embodiments envision the three-way connector 502 constricting the flow of water to the toilet bowl 514 to conserve water use in the toilet bowl and increasing water to the faucet 202 for faster handwashing water 508. When the water level 510 in the toilet tank 100 reaches the fill level of the toilet tank 100 (that which is set by the float 120), the float 120 actuates the shutoff valve to a closed position thereby stopping water from flowing into the toilet bowl refill tube 104.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the summary is expressed. For example a faucet constructed from a simple, essentially unitary piece of material having a rotation limiting key can be used in a consistent manner with embodiments of the present invention while still maintaining substantially the same functionality without departing from the scope and spirit of the present invention. Another example can include various mechanisms to secure a flexible tube in the faucet end without departing from the scope and spirit of the present invention. Other embodiments contemplate another three-way coupler connected to the bowl refill tube 104 that diverts water out of the toilet tank 100 for other uses, such as a drip system in a garden, for example. Yet other embodiments envision a filtration system between the retention tube and the faucet, for example.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed.

What is claimed is:

1. A toilet tank washbasin comprising:

a base;

a rim extending from the perimeter of said base, said base and said rim defining a basin, said basin adapted to rest on top of a toilet tank;

a drain that leads to said toilet tank;

a faucet possessing a faucet base attachable to said basin, said faucet extending from said faucet base distally to a faucet end, said faucet further possessing a tube extending essentially from said faucet end beyond said faucet base and terminating at a proximal tube end, said tube passing through an accommodating opening in said base, said proximal tube end adapted to receive water from a bowl refill tube, said faucet end configured to direct water towards said drain, and said faucet base possessing a key protrusion that mates with a key slot in said base that rigidly positions said faucet end over said drain.

2. The toilet tank washbasin of claim 1 wherein said basin essentially conforms to the top of said toilet tank.

3. The toilet tank washbasin of claim 1 wherein the faucet is curved towards said base.

4. The toilet tank washbasin of claim 1 wherein said tube is flexible.

5. The toilet tank washbasin of claim 4 further possessing a plurality of barbs integrated at said faucet end configured to retain said tube unidirectionally at said faucet end.

6. The toilet tank washbasin of claim 5 wherein each of said barbs possess a ramped portion that is widest closest to said faucet end and terminating with an edge having an angle less than 90 degrees relative to said ramp.

7. The toilet tank washbasin of claim 4 further possessing at least one barb adapted to retain said tube from sliding into said faucet at essentially said faucet end.

8. The toilet tank washbasin of claim 4 further possessing a plurality of ribbed structures in said faucet to position said tube internally along said faucet.

9. The toilet tank washbasin of claim 4 further possessing a platform extending from said washbasin base to accommodate said faucet base.

10. The toilet tank washbasin of claim 1 further comprising a three-way connector possessing a first, second, and third port, said first port attached to said proximal tube end, said second port attached to said bowl refill tube, and said third port adapted to direct said water to a toilet bowl physically linked to said toilet tank.

11. The toilet tank washbasin of claim 4 further comprising a bite ring adapted to permit said tube to move only one direction through said bite ring, said one direction being towards said faucet end.

12. The toilet tank washbasin of claim 1 further comprising an internal lip and an external lip that extends from said base to prevent said toilet tank washbasin from sliding off of the top of said toilet tank.

13. A toilet tank washbasin comprising:

a basin that sits atop an open toilet tank;

a faucet having a nozzle end, said faucet attached to said basin via a keyed member that a) positions said nozzle end over a drain in said basin and b) prevents rotation of said faucet when attached to said basin, said drain leads into said toilet tank;

a flexible tube that attaches to a bowl refill tube, said bowl refill tube is a water source to said toilet tank, said flexible tube extends through said faucet and terminates essentially at said nozzle end; and a means for retaining said flexible tube at said nozzle end.

14. The toilet tank washbasin of claim 13 wherein said means for retaining said flexible tube at said nozzle end prevents said flexible tube from slipping only into said faucet via said nozzle end.

15. The toilet tank washbasin of claim 13 further comprising retaining members that extend on both the outside of said toilet tank preventing said toilet tank washbasin from sliding off of the top of said toilet tank.

16. The toilet tank washbasin of claim 13 wherein said faucet possesses a plurality of ribbed channels that retain said flexible tube along the inside of said faucet.

17. The toilet tank washbasin of claim 13 further comprising a three-way connector possessing a first, second, and third port, said first port attached to said proximal tube end, said second port attached to said bowl refill tube, and said third port adapted to direct said water to a toilet bowl physically linked to said toilet tank.

18. The toilet tank washbasin of claim 17 wherein said three-way connector provides said water at a different rate to said first port than said third port.

19. A toilet tank washbasin comprising:

a basin adapted to sit atop an open toilet tank;

a faucet having a nozzle end, said faucet attached to said basin via a keyed member that rotationally locks said faucet nozzle end over a drain in said basin, said drain leading into said toilet tank;

a flexible tube adapted to attach to a bowl refill tube that is arranged to provide water to at least said flexible tube, said flexible tube extends through said faucet and terminates essentially at said nozzle end; and a means for retaining said flexible tube at said nozzle end.

20. The toilet tank washbasin of claim 19 further comprising a means for delivering said water to said flexible tube and a toilet bowl physically connected to said toilet tank.

* * * * *